US011576501B2

(12) United States Patent
Lade et al.

(10) Patent No.: US 11,576,501 B2
(45) Date of Patent: Feb. 14, 2023

(54) GUIDE VANE FOR REFRIGERATED DISPLAY CASE

(71) Applicant: Hill Phoenix, Inc., Conyers, GA (US)

(72) Inventors: Karuna Kumari Lade, Glen Allen, VA (US); Udhayabaskar Manivannan, Mudaliarpet (IN); Atul Singhal, CV Raman Nagar (IN)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 17/084,917

(22) Filed: Oct. 30, 2020

(65) Prior Publication Data

US 2021/0137283 A1 May 13, 2021

Related U.S. Application Data

(60) Provisional application No. 62/932,732, filed on Nov. 8, 2019.

(51) Int. Cl.
*A47F 3/04* (2006.01)
*A47F 7/00* (2006.01)

(52) U.S. Cl.
CPC ..... *A47F 3/0447* (2013.01); *A47F 7/0071* (2013.01)

(58) Field of Classification Search
CPC ..... A47F 3/0447; A47F 3/001; A47F 3/007; A47F 3/04; A47F 3/0439; A47F 3/0443; A47F 3/0452; A47F 3/0456; A47F 3/0465; A47F 7/0071; F25D 2317/0665; F25D 2317/0672
See application file for complete search history.

(56) References Cited

U.S. PATENT DOCUMENTS 2,725,726 A * 12/1955 Swanson ..... A47F 3/0447 454/341
2,967,404 A * 1/1961 Detwiler ..... A47F 3/0443 62/275
3,063,252 A * 11/1962 Lamb ..... A47F 3/0447 62/283
3,063,256 A * 11/1962 Lamb ..... A47F 3/0447 62/283
3,082,612 A * 3/1963 Beckwith ..... A47F 3/0447 62/282
3,128,609 A * 4/1964 Beckwith ..... A47F 3/0447 62/275
3,163,024 A * 12/1964 Beckwith ..... A47F 3/0447 454/193

(Continued)

*Primary Examiner* — Patrick D Hawn
(74) *Attorney, Agent, or Firm* — Fish & Richardson P.C.

(57) ABSTRACT

A refrigerated display case having a front and including a duct to direct an air stream flow through a bottom, a back, and a top of the refrigerated display case, a guide vane communicating with the top of the duct to redirect the air stream flow along the front of the refrigerated display case, and a receiver coupled to the bottom of the duct to accept the air stream flow redirected by the guide vane. The guide vane includes a top wall, a bottom wall, a pair of side walls, a first end region, a second end region, a plurality of internal wall, and a plurality of flow paths extending between the first end region and the second end region and defined between the pair of side walls, and at least two of the top wall, the bottom wall, a first internal wall of the plurality of internal walls, and a second internal wall of the plurality of internal walls.

35 Claims, 5 Drawing Sheets

(56) References Cited

U.S. PATENT DOCUMENTS 3,203,337 A * 8/1965 Beckwith ..... A47F 3/0447 454/193
3,233,423 A * 2/1966 Beckwith ..... A47F 3/0447 454/193
3,304,736 A * 2/1967 Brennan ..... A47F 3/0447 454/193
3,403,525 A * 10/1968 Beckwith ..... F25D 21/125 62/282
3,420,070 A * 1/1969 Hermanson ..... A47F 3/0447 62/264
3,528,258 A * 9/1970 Brennan ..... A47F 3/0447 454/193
3,771,323 A * 11/1973 Simons ..... A47F 3/0447 62/93
3,827,254 A * 8/1974 MacMaster ..... A47F 3/0447 62/89
3,850,003 A * 11/1974 Beckwith ..... F25D 21/125 62/282
4,269,037 A * 5/1981 Karashima ..... A47F 3/0447 62/256
4,326,385 A * 4/1982 Ibrahim ..... F25D 21/125 62/282
4,760,708 A * 8/1988 Karashima ..... A47F 3/0447 62/255
4,964,281 A * 10/1990 Tanaka ..... A47F 3/0447 62/256
5,357,767 A * 10/1994 Roberts ..... F25D 21/125 454/193
6,722,149 B1 * 4/2004 Saroka ..... A47F 3/0447 454/193
6,742,344 B2 * 6/2004 Vormedal ..... F25D 23/023 454/193
6,931,877 B2 * 8/2005 Kasuya ..... F25D 23/023 454/193
7,162,882 B2 * 1/2007 Alahyari ..... A47F 3/0447 62/89
7,497,770 B2 * 3/2009 Grassmuck ..... A47F 3/0447 454/193
7,681,409 B2 * 3/2010 Alahyari ..... A47F 3/0447 62/255
7,806,543 B2 * 10/2010 Swofford ..... A47F 3/0439 362/604
7,918,516 B2 * 4/2011 Decker ..... F25D 25/02 108/108
8,647,183 B2 * 2/2014 Swofford ..... A47F 3/0447 62/82
8,858,309 B2 * 10/2014 Grassmuck ..... A47F 3/0447 454/193
9,265,359 B2 * 2/2016 Wood ..... A47F 3/0478
9,675,185 B2 * 6/2017 Anderson ..... A47F 3/0447
9,788,666 B2 * 10/2017 Wood ..... G09F 3/204
10,219,638 B2 * 3/2019 Wood ..... A47F 3/0447
10,765,231 B2 * 9/2020 Eget ..... F25D 23/023
2003/0217560 A1 * 11/2003 Kasuya ..... F25D 23/023 62/256
2007/0012059 A1 * 1/2007 Roche ..... A47F 3/0447 62/251
2016/0278542 A1 * 9/2016 Eget ..... F25D 23/023
2017/0340141 A1 * 11/2017 Schwarz ..... A47F 3/0447
2021/0106150 A1 * 4/2021 Berents ..... A47F 3/001

* cited by examiner

GUIDE VANE FOR REFRIGERATED DISPLAY CASE

CROSS-REFERENCE TO RELATED APPLICATIONS

This application claims the benefit of priority to U.S. Provisional Application No. 62/932,732, filed on Nov. 8, 2019, the complete disclosure of which is hereby incorporated herein by reference in its entirety.

BACKGROUND

Typically, a front of a refrigerated display case utilizes an air curtain to maintain a controlled temperature within the refrigerated display case. The air curtain may function as a barrier between refrigerated air and ambient air. The air curtain is typically created by discharging air from an air discharge located at a top-front portion of the refrigerated display case and receiving air at an air return located at a bottom-front portion of the refrigerated display case. It would be desirable to provide a guide vane for use with the air discharge to create an efficient air velocity profile for the air curtain.

SUMMARY

One embodiment of the disclosure relates to a refrigerated display case. The refrigerated display case has a front and includes a duct configured to direct an air stream flow therethrough a bottom, a back, and a top of the refrigerated display case. A guide vane communicates with the top of the duct at the air discharge and is configured to redirect the air stream flow in the form of an air curtain along the front of the refrigerated display case. An air return or receiver is located at the lower front of the case and is coupled to the bottom of the duct accept and return the air stream flow. The guide vane has an approximate "L" shape and includes a top wall, a bottom wall, a pair of side walls, a first end region and a second end region. The first end region and the second end region are located at opposite ends of the guide vane. A number of approximately parallel and "L" shaped internal walls extend between the first end region and the second end region. A number of approximately parallel and "L" shaped flow paths extend between the first end region and the second end region and are defined laterally between the pair of side walls, and above and beneath by at least two of the top wall, the bottom wall, a first internal wall of the plurality of internal walls, and a second internal wall of the plurality of internal walls. The flow paths are sized and shaped to direct an air stream from the duct in the top of the case, through the guide vane, and down across the open front of the case in the form of an air curtain having an improved laminar flow profile.

DETAILED DESCRIPTION

Referring to the Figures generally, systems, and apparatuses for a guide vane or guide vane for a refrigerated display case are shown.

Open-front refrigerated display cases typically include an air curtain for maintaining a desired temperature within the refrigerated display case. The refrigerated display case may store and display products such as meats, cheeses, dairy, frozen goods, and refrigerated goods to a consumer. In some applications, it is desirable to accentuate and enhance the appearance of the products (e.g., to attract consumers, etc.).

According to the present disclosure, a refrigerated display case includes a top portion with an air curtain discharge opening, a bottom portion with an air curtain return, and a guide vane disposed within the top portion at the air curtain discharge. The air curtain discharge is defined by, or has disposed within, the guide vane, which directs an air stream, such that the guide vane changes the direction of flow of the air stream from a horizontal direction as the air stream passes through the top portion of the case, to a substantially vertical direction as an air curtain that travels air curtain downwardly across the open front to the air curtain return, thus forming the air curtain. The guide vane includes an air stream straightener that is configured (e.g., structured, etc.) to change the velocity profile of the air stream. It is desirable that the velocity profile be as uniform, laminar, and without stagnation as much as practical to allow for optimal thermal qualities in the refrigerated display case.

Figure 1:
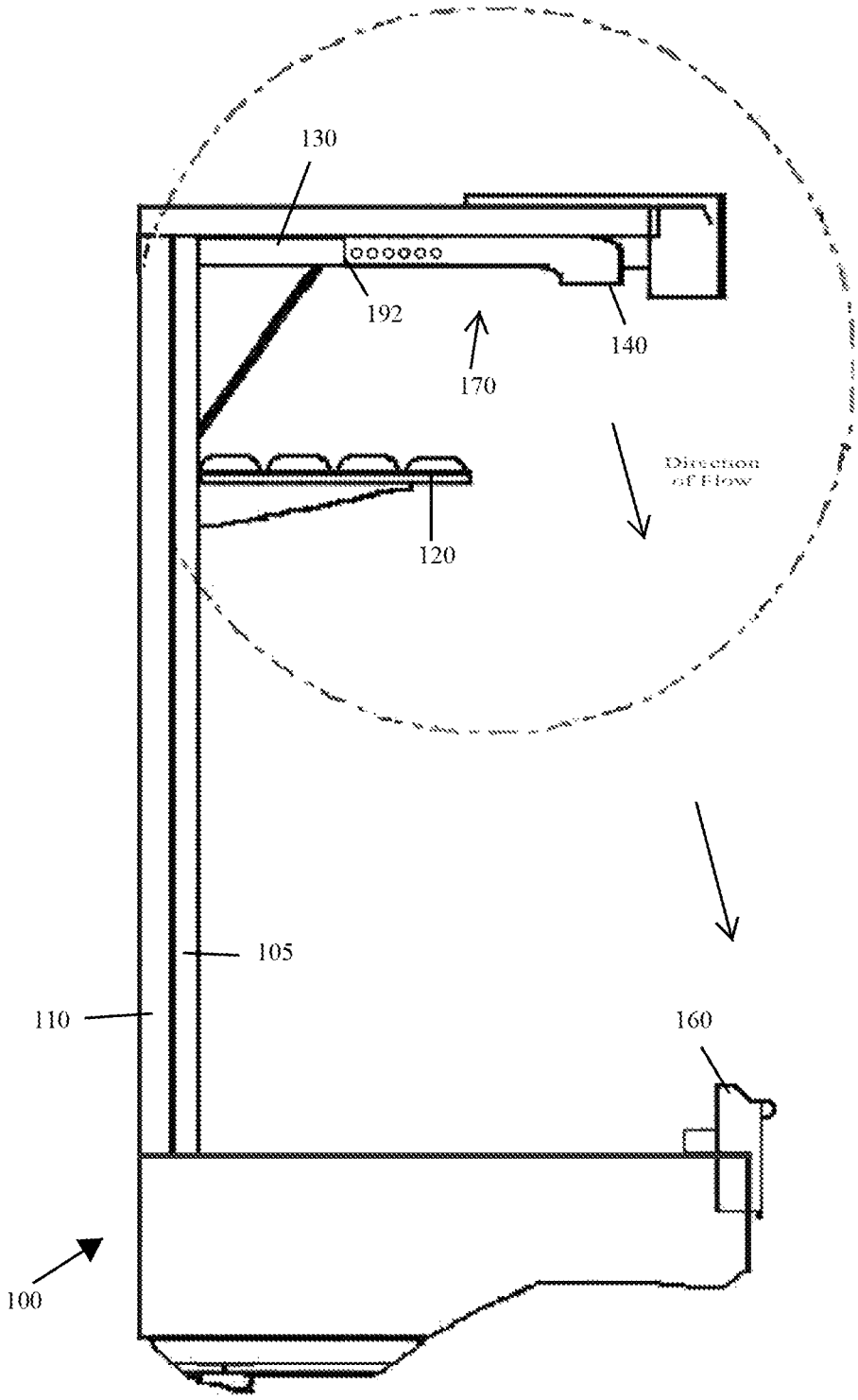
FIG. 1 is a side view illustration of a refrigerated display case according to an exemplary embodiment.
Figure 2:
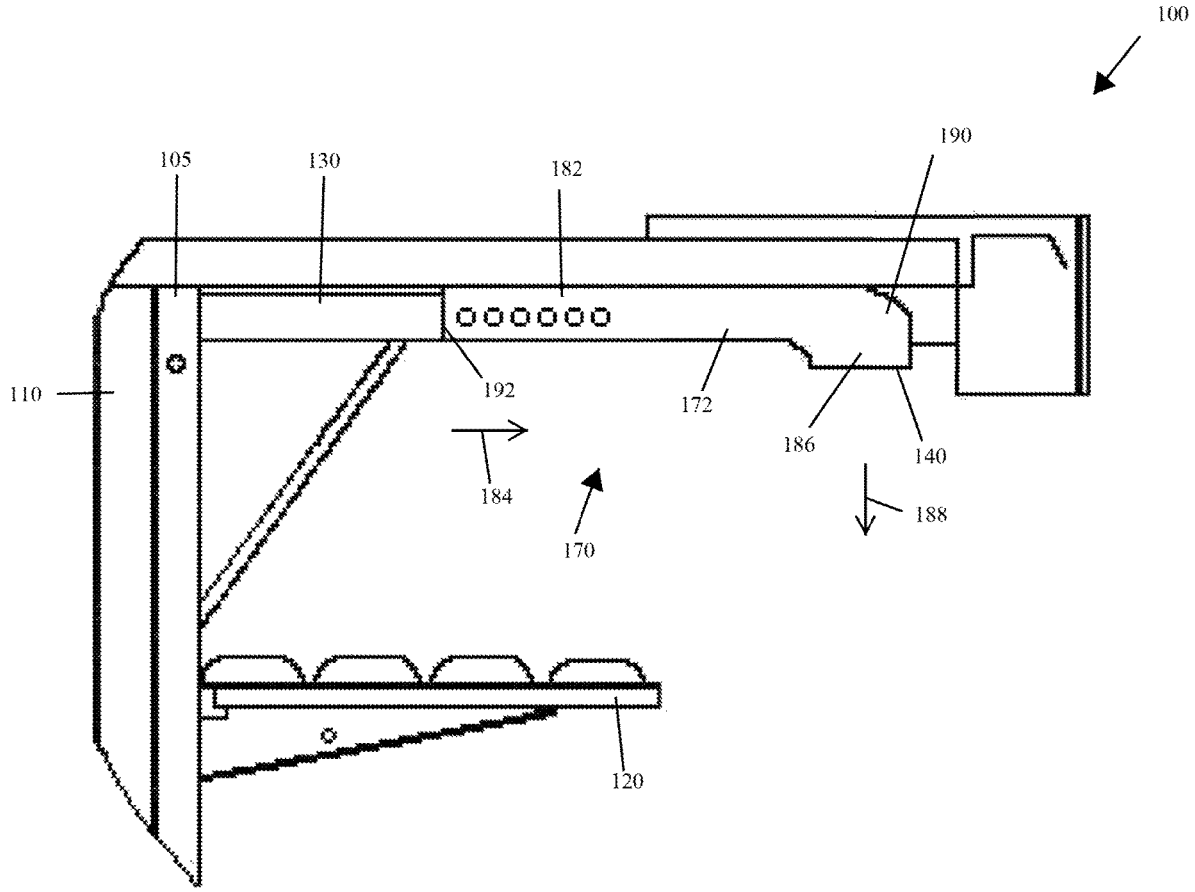
FIG. 2 is a partial section view of a top portion of the refrigerated display case according to the embodiment of FIG. 1.

Referring to FIGS. 1-2, a refrigerated display case 100, includes a frame (e.g., body, etc.) 110. Frame 110 may support one or more shelves, shown for example as shelf (e.g., protrusion, flange, etc.) 120. Shelf 120 is configured to receive and support products (e.g., meats, cheeses, dairy, frozen goods, refrigerated goods, etc.) for display to a consumer.

Frame 110 also includes a top portion 130 that can be substantially horizontal with an air discharge opening 140, a substantially horizontal bottom, which typically houses one or more air-flow and cooling devices, such as evaporator fan-coil units (not shown) and includes an air curtain return 160. According to various embodiments, refrigerated display case 100 is configured to produce an air curtain across the open front. To form the air curtain, an air stream may be drawn inward through air curtain return 160, through air-flow and cooling devices and forced through a passage 105 (e.g., a duct, etc.) disposed within frame 110.

Top portion 130 includes at least one air discharge opening (e.g., opening, cut-out, vent, channel, etc.) 140. Air discharge opening 140 receives the air stream from the top portion 130 and redirects the air stream vertically downward across the open front of refrigerated display case 100. The air curtain originates from air discharge opening 140, and terminates upon being received at the air curtain return 160. In many applications, the air curtain generally follows a linear or semi-linear path as it flows between air discharge opening 140 and the air curtain return 160.

Top portion 130 also includes one or more guide vanes 170 (e.g., turning guide vanes, etc.) to further define the air discharge opening 140 and redirecting the air stream through the air discharge opening 140. By way of example, two guide vanes 170, each of which may be approximately 4 feet in width, are disposed within the top portion 130 of a refrigerated display case 100 having a width of approximately 8 feet. The guide vane 170 and the top portion 130 are configured to fluidly communicate, such that the air stream travels through the top portion 130 and into the guide vane 170. In some embodiments, the top portion 130 and guide vane 170 can be fixedly coupled with, for example, adhesive, bolts, welding, etc. According to one embodiment, the guide vane 170 can include a structure to secure the guide vane 170 to the top portion 130 (e.g., holes configured to accept bolts, etc.). In other embodiments, the top portion 130 and the guide vane 170 can be removably coupled. According to another embodiment, the guide vane 170 may include a comb-like structure which is configured to snap into a similar comb-like structure within the top portion 130 to removably couple the guide vane 170 and the top portion 130.

Figure 3:
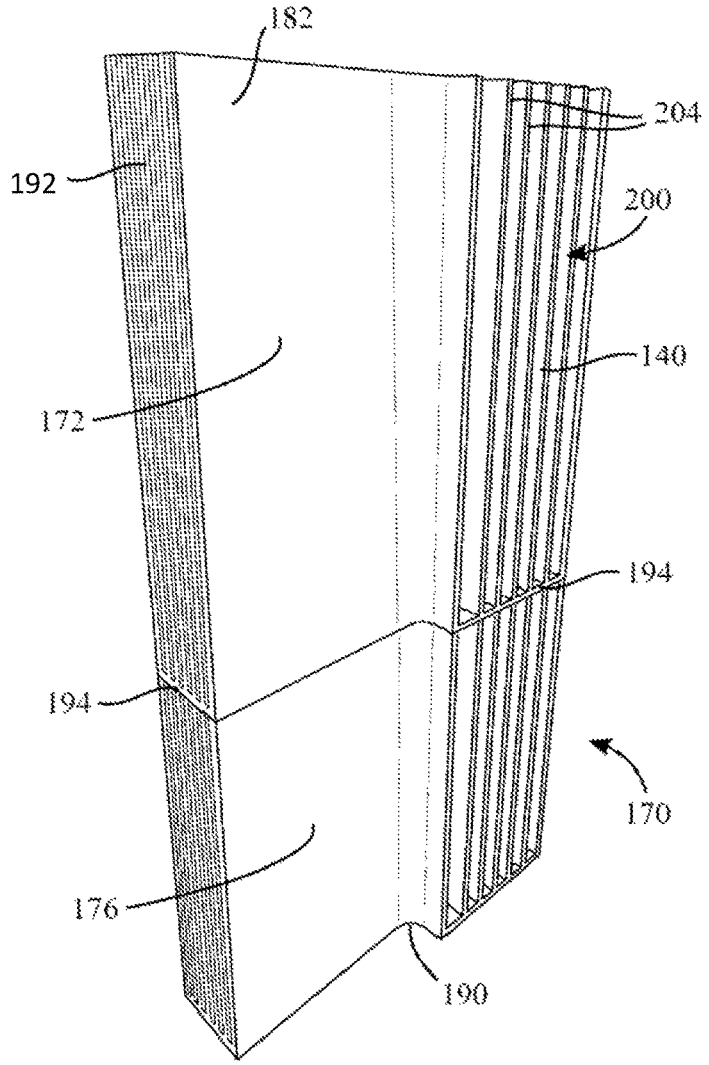
FIG. 3 is a perspective view of a guide vane for use in the refrigerated display case of FIG. 1, according to an exemplary embodiment.
Figure 4:
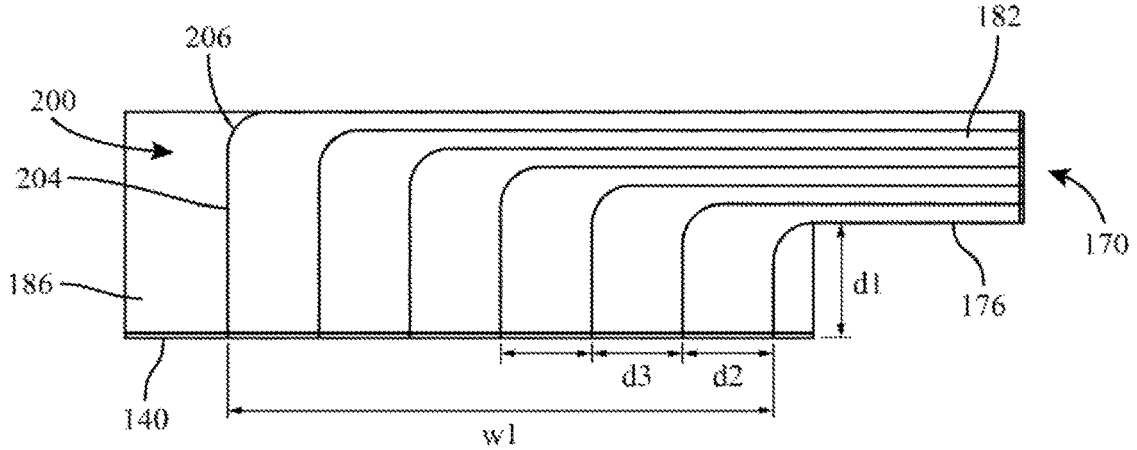
FIG. 4 is a partial section view of the guide vane of the present disclosure.

Referring to FIGS. 3-4, an embodiment of the guide vane 170 is shown. The guide vane 170 includes a body 172 defined by a top wall, a bottom wall 176, a first side wall, and a second side wall. The top wall and the bottom wall 176 are formed in an approximate "L" shape and spaced apart from and parallel to each other. The first side wall and the second side wall form sides of the guide vane 170 to minimize leakage of air from the guide vane 170. The first side wall and the second side wall may be perpendicular to the top wall and the bottom wall 176 and parallel to each other. Examples of materials suitable for the guide vane 170 are sheet metal, plastic, etc.

The body 172 has a first end region shown as inlet leg 182 (e.g., section, portion, etc.) extending in a first direction 184 (e.g. horizontally, etc.) that is substantially the same as a direction of the air stream flow through the top portion 130, and a second end region shown as outlet leg 186 extending in a second direction 188 (e.g. vertically, etc.). The first direction 184 can be in the same or a different direction than that of the second direction 188. The air stream is redirected from the first direction 184 to the second direction 188 via a redirection section 190 (e.g. an elbow, turn, curve, etc.) in the body 172. The outlet leg 186 can extend a distance from the redirection section 190 and the inlet leg 182 can extend a distance from the redirection section 190. In some embodiments, the extension distance of the outlet leg 186 from the redirection section 190 is different (e.g., larger, smaller, etc.) than the extension distance of the inlet leg 182 from the redirection section 190. In other embodiments, the extension distance of the outlet leg 186 from the redirection section 190 is the same as the extension distance of the inlet leg 182 from the redirection section 190.

The guide vane 170 can include a middle wall 194 located between and parallel to the first side wall and the second side wall. In some embodiments, the middle wall 194 can be located closer to one of the first side wall or the second side wall. In other embodiments, the middle wall 194 can be located an equal distance from the first side wall and the second side wall. The middle wall 194 can provide support for the guide vane 170 to minimize deformation during use. The guide vane 170 includes an air straightener 200, configured to separate the air stream into one or more air streams.

The air straightener 200 extends at least partially between an inlet 192 defined by the inlet leg 182 and the air discharge opening 140 defined by the outlet leg 186, such that the guide vane 170 defines one or more apertures (e.g., flow paths, etc.). In some embodiments, the air straightener 200 is positioned within at least one of the outlet leg 186, the redirection section 190, and the inlet leg 182 of the guide vane 170. The air stream straightener can include one or more air straightener walls 204 (e.g., internal walls, etc.) extending at least partially from the first side wall to the second side wall. The air straightener walls 204 can include a bend having a bend radius. The bend can be located on the air straightener walls 204 at a distance from the inlet 192 the same or different than a distance from the inlet leg 182 as the redirection section 190. In some embodiments, the bend radius can be the same for each air straightener wall 204. In other embodiments, the bend radius can be different for a first air straightener 200 wall and a second air straightener 200 wall. The air straightener walls 204 are configured to define at least two flow paths for the air stream within the guide vane 170. The flow paths can have various sizes and shapes.

In some embodiments, two or more air straightener walls 204 are parallel to the top wall and the bottom wall 176 or the first side wall and the second side wall. A distance between a first air straightener 200 wall and a second air straightener 200 wall can vary along the length of the guide vane 170. In some embodiments, the first air straightener 200 wall and the second air straightener 200 wall may be a first distance from each other along the inlet leg 182 and a second distance from each other along the outlet leg 186. The first distance may be the same or different than the second distance. In other embodiments, a first air straightener 200 wall is a first distance from a second air straightener 200 wall and the air straightener 200 is a second distance from a third air straightener wall 204. In this embodiment, the first distance may be the same or different than the second distance.

According to one embodiment of the air straightener 200, the air straightener 200 includes the body 172 as previously discussed. The outlet leg 186 extends a distance d1 from the bottom wall 176 in the first direction 184. The outlet leg 186 defines the air discharge opening 140 and the air discharge opening 140 has a width w1. At least two air straightener walls 204 extend from the inlet 192 of the body 172 to the air discharge opening 140 also defined by the body 172. In one embodiment, the air straightener walls 204 are coupled to the first side wall and the second side wall and are parallel to the top wall and the bottom wall 176. In another embodiment, the air straightener walls 204 are coupled to the top wall and the bottom wall 176 and are parallel to the first side wall and the second side wall. Each air straightener walls 204 are spaced a distance d2 from a previous air straightener wall 204, and spaced a distance d3 from a next air straightener wall 204. As will be discussed later, the distance d2 and the distance d3 for each air straightener wall 204 can be the same or different. The air straightener walls 204 can be parallel (e.g., the same distance apart) from the inlet 192 to the air discharge opening 140. In other embodiments, the air straightener walls 204 can be a first distance apart for a first length (e.g., the length of the inlet leg 182, etc.) and be a second distance apart for a second length (e.g., the length of the outlet leg 186, etc.).

In another embodiment of the air straightener 200, the air straightener 200 includes a first side wall and a second side wall. The first side wall and the second side wall have a length greater than a width (e.g., bars, rods, etc.). The first side wall and the second side wall are parallel (e.g., extending in the same direction). The air straightener 200 includes one or more air straightener walls extending between the first side wall and the second side wall. The air straightener 200 has a width (e.g., 3 inches) defined as the distance between an outside side (e.g., a side of the guide vane 170) of a first air straightener 200 and an outside side of a last air straightener 200. The width is equal to a width of the guide vane 170.

In some embodiments, the air straightener walls can have a top surface and a bottom surface that are not equal widths. The top surface has a width and the bottom surface has a width (e.g., 0.37 inches). The width of the top surface is less than the width of the bottom surface, such that a side extending between the top surface and the bottom surface is at an angle $\alpha 1$ (e.g., 10°) relative to the direction of the air stream. The air stream straighteners are spaced apart, such that the top surface of a first air straightener 200 is spaced a width (e.g., 0.39 inches) from the top surface of a second air straightener 200. The bottom surface of the first air straightener 200 is spaced a width (e.g., 0.22 inches) from the bottom surface of the second air straightener 200. The air straightener 200 has a height (e.g., 0.5 inches) defined by the distance between the bottom surface and the top surface. In other embodiments, the width of the top surface and the width of the bottom surface are equal.

In a further embodiment of the air straightener 200, the air straightener 200 can be rectangular in shape, defining a width (e.g., 3 inches) that is equal to the width of the air discharge opening 140 defined by the guide vane 170, and a length (e.g., 31 inches) that is equal to the length of the air discharge opening 140. The air straightener 200 includes a first side wall and a second side wall. The length is defined between the first side wall and the second side wall. The first side wall and the second side wall have a length equal to the width. The air straightener 200 also includes a top wall and a bottom wall 176. The top wall couples to a top of the first side wall and a top of the second side wall and the bottom wall 176 couples to a bottom of the first side wall and a bottom of the second side wall.

The air straightener 200 includes a middle wall extending between the first side wall and the second side wall, and parallel to the top wall and the bottom wall 176. The middle wall is centered between the top wall and the bottom wall 176, such that a width (e.g., 1.5 inches) defined by the distance between the top wall and the middle wall is the same as the distance between the bottom wall 176 and the middle wall. The air straightener 200 further includes one or more intersecting walls extending from the top wall to the bottom wall 176, and intersecting the middle wall. Each intersecting wall can be at a distance from the next intersecting wall that is equal to the distance between the previous two intersecting walls. A pair of angled walls intersects the middle wall at the same location as the intersecting wall and extends from the top wall to the bottom wall 176. Each of the angled walls is rotated around the intersecting location relative to the intersecting wall at an angle (e.g., approximately 15.4°).

The angled walls and the intersecting walls are positioned in a pattern, such that a first angled wall extends from a first location on the top wall to a third location on the bottom wall 176, a first intersecting wall extends from a second location on the top wall to a second location on the bottom wall 176, a second angled wall extends from the top wall at a third location to a first location on the bottom wall 176, and a second intersecting member extends from the third location on the top wall to the third location on the bottom wall 176. The first location on the top wall and the first location on the bottom wall 176 are the same distance from the first side wall, similar to the second location on the top wall and the second location on the bottom wall 176 being equal distance from the first side wall, and the third locations on the top wall and the bottom wall 176 being equal distance from the first side wall. The first angled wall is rotated at an angle, relative to the intersecting wall. The second angled wall is rotated at an angle the same as the first angled wall but in a negative direction, relative to the intersecting wall.

In yet another embodiment of the air straightener 200, the air straightener 200 can include a top wall, a bottom wall 176, a first side wall, and a second side wall. The top wall, and the bottom wall 176 are parallel to each other and perpendicular to the first side wall, and the second side wall. The top wall, the bottom wall 176, the first side wall, and the second side wall can each have a rectangular cross-section. The width of the cross-section (e.g., approximately 0.04 inches) is smaller than a height of the cross-section. The top wall and the bottom wall 176 are spaced apart at a width of (e.g., approximately 3 inches) that is equal to the width of the guide vane 170.

The air straightener 200 includes one or more air straightener walls extending from the first side wall and through the second side wall. The air straightener walls extend outwardly from the second side wall. The first of the air straightener walls is a distance (e.g., approximately 0.10 inches) from the bottom wall 176, and the last of the air straightener walls is a distance (e.g., approximately 0.9 inches) from the top wall. Each of the air straightener walls is spaced equally apart from the next air straightener wall at a distance (e.g., approximately 0.13 inches). The air straightener walls have a width of (e.g., approximately 0.04 inches).

A 2-level full factorial design was utilized to determine optimization of the distance d1, width w1, and ratio r to produce desired properties (e.g., maximum thermal retention, etc.). The objective of optimization was to maximize discharge velocity (e.g., $V_{max}$, etc.), minimize turbulent kinetic energy (e.g., TKE, etc.), and maximize the air curtain length (e.g., L, etc.). Regression equations were used to relate performance parameters (e.g., $V_{max}$, TKE, L, etc.) to design variables (e.g., d1, w1, r, etc.).

$$V\max=1127-284.1(d1)-186.1(w1)-720(r)+93.89(d1*w1)+284.9(d1*r)+178.4(w1*r)-106.4(d1*w1*r)$$

$$\mathrm{TKE}=0.2277-0.1678(d1)-0.04223(w1)+0.2567(r)+0.03955(d1*w1)+0.1564(d1*r)+0.09143(w1*r)+0.04877(d1*w1*r)$$

$$L=35.82-141.9(d1)+1.967(w1)+16.63(r)+33.66(d1*w1)+120.7(d1*r)-14.62(w1*r)-23.53(d1*w1*r)$$

The input distance d1 ranges from 0.5-1 inches, with the starting value being 0.75 inches. The input width w1 ranges from 2-4 inches, with the starting value being 3 inches. The input ratio r ranges from 0.7-1, with the starting value being 0.85. The 2-level factorial design also included desirability factors of optimum design to indicate the effectiveness of the guide vane 170 in maximizing $V_{max}$ and L, and minimizing TKE, and included a composite desirability factor of 0.769 to signify the effectiveness of an optimized guide vane 170 design to achieve goals (e.g., maximum $V_{max}$, maximum L, minimum TKE, etc.) defined for the performance parameters. The desirability factor of $V_{max}$ was 0.877, of TKE was 0.756, and of L was 0.686 indicating the guide vane 170 may be more effective in maximizing $V_{max}$ than maximizing L. The 2-level factorial design resulted in optimized values of distance d1 being 0.5 inches, of width w1 being 2 inches, and of ratio r being 0.753863 to achieve maximum $V_{max}$, maximum L, and minimum TKE.

Figure 5:
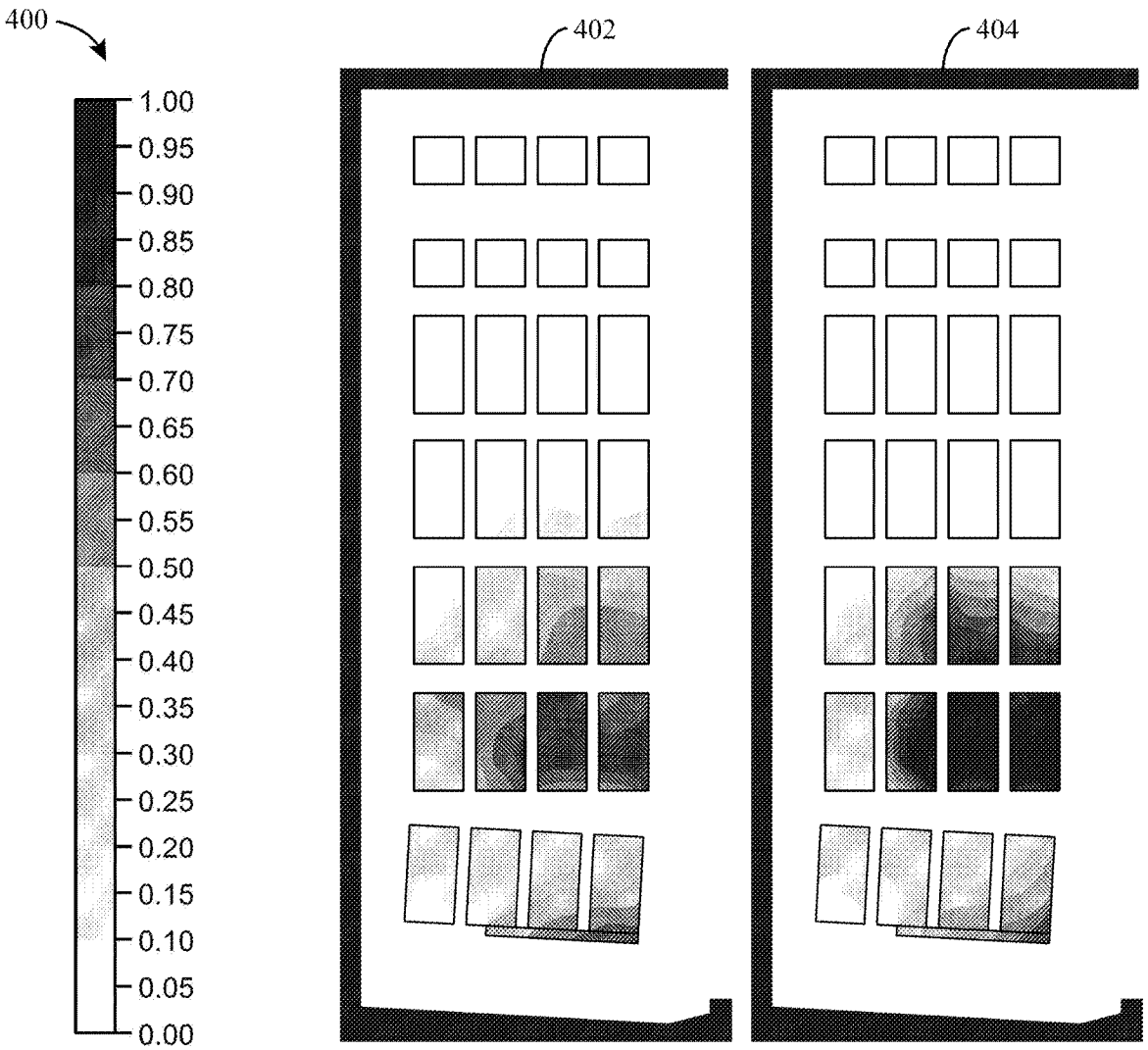
FIG. 5 is an illustration of a normalized temperature of the guide vane of the present disclosure in comparison to a prior art air straightener.

A CFD simulation was performed using the optimized values of distance d1, width w1, and ratio r for the guide vane 170. More uniform velocity at each shelf 120, a more uniform velocity profile at the air discharge opening 140, and better thermal retention of the refrigerated display case 100 compared to prior air straighteners were shown. Specifically, in a closed door condition (e.g., shelves 120 isolated from an ambient environment, etc.) the air curtain had 23% higher flow velocity and a wider bell-shaped velocity profile when compared to prior air straighteners. In an open door condition (e.g., shelves 120 in communication with an ambient environment, etc.), the guide vane 170 had a 40% improvement in normalized product temperature and a 30% reduction in rise of normalized temperature of the air curtain when compared to prior air straighteners. Referring to FIG. 5, illustration 400 depicts the normalized temperature of an open door condition of the refrigerated display case 100. Diagram 402 depicts the normalized temperatures for a refrigerated display case 100 including the guide vane 170, and diagram 404 depicts the normalized temperatures for a refrigerated display case 100 including prior air straighteners.

Figure 6:
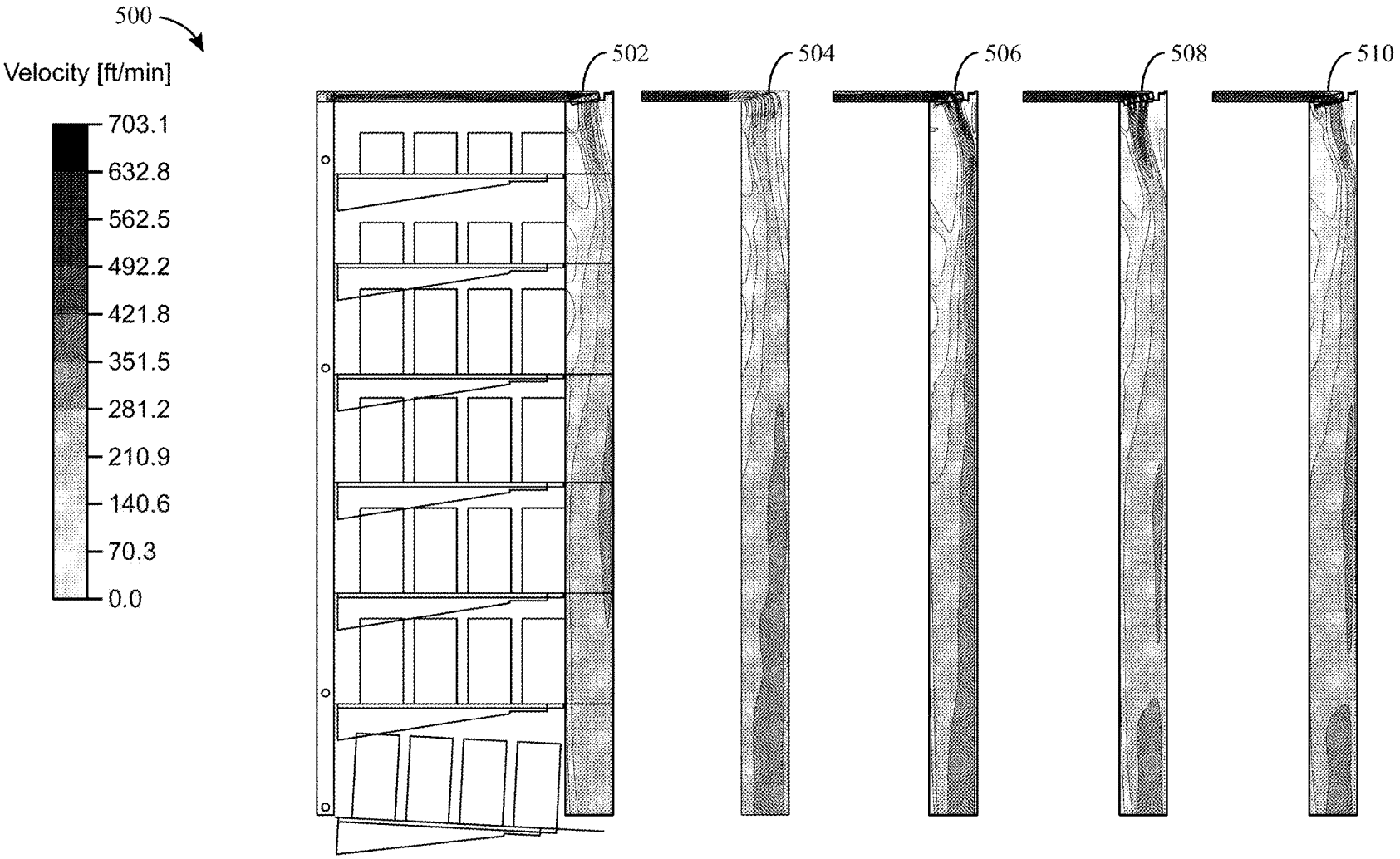
FIG. 6 is an illustration of a velocity profile of a prior art straightener in comparison to the guide vane of the present disclosure and various air straighteners.

As shown in FIG. 6, results 500 from another CFD representing various velocity profiles is shown. The CFD simulated velocity profiles of the air stream flowing through the refrigerated display case 100 at a velocity, and out of one of the guide vane 170 and various prior art air straighteners. Velocity profile 502 is a velocity profile for a prior art design of an air straightener. Velocity profile 504 is a velocity profile for the above described embodiment of the guide vane 170 of the present disclosure. Velocity profile 506, velocity profile 508, and velocity profile 510 are velocity profiles for various embodiments of an air straightener. From the results, velocity profile 504 has the least amount of velocity stagnation (e.g., small velocities, etc.) and a more uniform velocity profile (e.g., similar velocity over the entirety of the shelves 120, etc.). Therefore the guide vane 170 is shown to be optimal for releasing the air stream from the air discharge opening 140 to the air curtain return 160 at a more uniform velocity, reducing velocity stagnation, and maximizing temperature retention within the refrigerated display case 100.

The embodiments described herein have been described with reference to drawings. The drawings illustrate certain details of specific embodiments that implement the systems, methods and programs described herein. However, describing the embodiments with drawings should not be construed as imposing on the disclosure any limitations that may be present in the drawings.

The present disclosure is not limited to the particular methodology, protocols, and expression of design elements, etc., described herein and as such may vary. The terminology used herein is for the purpose of describing particular embodiments only, and is not intended to limit the scope of the present disclosure.

As used herein, the singular forms include the plural reference and vice versa unless the context clearly indicates otherwise. The term "or" is inclusive unless modified, for example, by "either." For brevity and clarity, a particular quantity of an item may be described or shown while the actual quantity of the item may differ. Other than in the operating examples, or where otherwise indicated, all numbers expressing measurements used herein should be understood as modified in all instances by the term "about," allowing for ranges accepted in the art.

Unless defined otherwise, all technical terms used herein have the same meaning as those commonly understood to one of ordinary skill in the art to which this invention pertains. Although any known methods, devices, and materials may be used in the practice or testing of the inventive concepts, the methods, devices, and materials in this regard are described herein.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in deposit to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure

What is claimed is:

1. A refrigerated display case, the refrigerated display case comprising:

a duct configured to direct an air stream flow through a bottom, a back, and a top of the refrigerated display case;

a guide vane in airflow communication with a top portion of the duct and configured to provide the air stream flow along a front of the refrigerated display case, the guide vane comprising:

a top wall, a bottom wall, a pair of side walls, a first end region positioned to receive the air stream flow from the top portion of the duct, a second end region opposite the first end region, a plurality of internal walls that extend from the first end region to the second end region, the plurality of internal walls comprising at least two air straightener walls, each of the plurality of internal walls coupled to at least one of the top wall or the bottom wall and extending parallel with the pair of side walls, and a plurality of flow paths extending between the first end region and the second end region, each of the plurality of flow paths defined between the pair of side walls and at least two of: the top wall, the bottom wall, one of the two air straightener walls of the plurality of internal walls, and another of the two air straightener walls of the plurality of internal walls, where each of the plurality of flow paths is configured to direct at least a portion of the air stream flow through the guide vane from the first end region to the second end region; and a receiver coupled to the bottom of the duct and configured to accept the air stream flow redirected by the guide vane from the second end region, wherein the top wall and the bottom wall are parallel in a first direction for a first length and parallel in a second direction for a second length, and each of the at least two air straightener walls of the plurality of internal walls is perpendicular to the top wall and the bottom wall in the first direction for the first length and the second direction for the second length.

2. The refrigerated display case of claim 1, wherein the second direction is perpendicular to the first direction.

3. The refrigerated display case of claim 1, wherein the second length is 0.5 inches.

4. The refrigerated display case of claim 1, wherein the top wall and the bottom wall are spaced a distance of 2 inches apart at a location in which the top wall and the bottom wall extend in the second direction.

5. The refrigerated display case of claim 4, wherein the one of the two air straightener walls of the plurality of internal walls is a first air straightener wall and is spaced from the another of the two air straightener walls of the plurality of internal walls by a first distance, and the another of the two air straightener walls of the plurality of internal walls is a second air straightener wall and is spaced from a third air straightener wall of the plurality of internal walls by a second distance, wherein a ratio between the second distance to the first distance is within a range of approximately 0.7-0.8.

6. The refrigerated display case of claim 5, wherein the ratio between the second distance to the first distance is approximately 0.75.

7. The refrigerated display case of claim 5, wherein the second direction is perpendicular to the first direction.

8. The refrigerated display case of claim 1, wherein each of the at least two air straightener walls of the plurality of internal walls is coupled to both of the top wall and the bottom wall.

9. The refrigerated display case of claim 1, wherein the one of the two air straightener walls is spaced from the another of the two air straightener walls at the top wall a first distance, and the one of the two air straightener walls is spaced from the another of the two air straightener walls at the bottom wall a second distance.

10. The refrigerated display case of claim 9, wherein the first and second distances are different.

11. The refrigerated display case of claim 1, wherein the second direction is substantially parallel to a direction of gravity.

12. The refrigerated display case of claim 5, wherein the second direction is substantially parallel to a direction of gravity.

13. The refrigerated display case of claim 1, wherein the first end region comprises a plurality of inlets defined by the plurality of flow paths, each of the plurality of inlets in airflow communication with the top portion of the duct to receive the air stream flow from the duct.

14. The refrigerated display case of claim 13, wherein the second end region comprises a plurality of outlets defined by the plurality of flow paths, each of the plurality of outlets in airflow communication with the receiver across the front of the refrigerated display case.

15. The refrigerated display case of claim 14, wherein at least one of the plurality of inlets comprises an inlet area, and at least one of the plurality of outlets comprises an outlet area different than the inlet area.

16. The refrigerated display case of claim 14, wherein the front is open.

17. The refrigerated display case of claim 1, wherein the front is open.

18. The refrigerated display case of claim 1, further comprising at least one fan-coil unit in airflow communication with the duct and the receiver.

19. A refrigerated display case, the refrigerated display case comprising:

a duct configured to direct an air stream flow through a bottom, a back, and a top of the refrigerated display case;

a guide vane in airflow communication with a top portion of the duct and configured to provide the air stream flow along a front of the refrigerated display case, the guide vane comprising:

a top wall, a bottom wall, a pair of side walls, a first end region positioned to receive the air stream flow from the top portion of the duct, a second end region opposite the first end region, a plurality of internal walls that extend from the first end region to the second end region, the plurality of internal walls comprising at least two air straightener walls, each of the plurality of internal walls coupled to at least one of the top wall or the bottom wall and extending parallel with the pair of side walls, and a plurality of flow paths extending between the first end region and the second end region, each of the plurality of flow paths defined between the pair of side walls and at least two of: the top wall, the bottom wall, one of the two air straightener walls of the plurality of internal walls, and another of the two air straightener walls of the plurality of internal walls, where each of the plurality of flow paths is configured to direct at least a portion of the air stream flow through the guide vane from the first end region to the second end region; and a receiver coupled to the bottom of the duct and configured to accept the air stream flow redirected by the guide vane from the second end region, wherein the top wall and the bottom wall are parallel in a first direction for a first length and parallel in a second direction for a second length, the top wall and the bottom wall are spaced a distance of 2 inches apart at a location in which the top wall and the bottom wall extend in the second direction, and the one of the two air straightener walls of the plurality of internal walls is a first air straightener wall and is spaced from the another of the two air straightener walls of the plurality of internal walls by a first distance, and the another of the two air straightener walls of the plurality of internal walls is a second air straightener wall and is spaced from a third air straightener wall of the plurality of internal walls by a second distance, wherein a ratio between the second distance to the first distance is within a range of approximately 0.7-0.8.

20. A refrigerated display case, the refrigerated display case comprising:

a duct configured to direct an air stream flow through a bottom, a back, and a top of the refrigerated display case;

a guide vane in airflow communication with a top portion of the duct and configured to provide the air stream flow along a front of the refrigerated display case, the guide vane comprising:

a top wall, a bottom wall, a pair of side walls, a first end region positioned to receive the air stream flow from the top portion of the duct, a second end region opposite the first end region, a plurality of internal walls that extend from the first end region to the second end region, the plurality of internal walls comprising at least two air straightener walls, each of the plurality of internal walls coupled to at least one of the top wall or the bottom wall and extending parallel with the pair of side walls, and a plurality of flow paths extending between the first end region and the second end region, each of the plurality of flow paths defined between the pair of side walls and at least two of: the top wall, the bottom wall, one of the two air straightener walls of the plurality of internal walls, and another of the two air straightener walls of the plurality of internal walls, where each of the plurality of flow paths is configured to direct at least a portion of the air stream flow through the guide vane from the first end region to the second end region; and a receiver coupled to the bottom of the duct and configured to accept the air stream flow redirected by the guide vane from the second end region, wherein the top wall and the bottom wall are parallel in a first direction for a first length and parallel in a second direction for a second length, wherein one of the two air straightener walls is spaced from the another of the two air straightener walls at the top wall a first distance, and the one of the two air straightener walls is spaced from the another of the two air straightener walls at the bottom wall a second distance, and the first and second distances are different.

21. The refrigerated display case of claim 20, wherein the second direction is perpendicular to the first direction.

22. The refrigerated display case of claim 20, wherein the second length is 0.5 inches.

23. The refrigerated display case of claim 20, wherein the top wall and the bottom wall are spaced a distance of 2 inches apart at a location in which the top wall and the bottom wall extend in the second direction.

24. The refrigerated display case of claim 23, wherein the one of the two air straightener walls of the plurality of internal walls is a first air straightener wall and is spaced from the another of the two air straightener walls of the plurality of internal walls by a first distance, and the another of the two air straightener walls of the plurality of internal walls is a second air straightener wall and is spaced from a third air straightener wall of the plurality of internal walls by a second distance, wherein a ratio between the second distance to the first distance is within a range of approximately 0.7-0.8.

25. The refrigerated display case of claim 24, wherein the ratio between the second distance to the first distance is approximately 0.75.

26. The refrigerated display case of claim 24, wherein the second direction is perpendicular to the first direction.

27. The refrigerated display case of claim 20, wherein each of the at least two air straightener walls of the plurality of internal walls is coupled to both of the top wall and the bottom wall.

28. The refrigerated display case of claim 20, wherein the second direction is substantially parallel to a direction of gravity.

29. The refrigerated display case of claim 20, wherein the second direction is substantially parallel to a direction of gravity.

30. The refrigerated display case of claim 20, wherein the first end region comprises a plurality of inlets defined by the plurality of flow paths, each of the plurality of inlets in airflow communication with the top portion of the duct to receive the air stream flow from the duct.

31. The refrigerated display case of claim 30, wherein the second end region comprises a plurality of outlets defined by the plurality of flow paths, each of the plurality of outlets in airflow communication with the receiver across the front of the refrigerated display case.

32. The refrigerated display case of claim 31, wherein at least one of the plurality of inlets comprises an inlet area, and at least one of the plurality of outlets comprises an outlet area different than the inlet area.

33. The refrigerated display case of claim 32, wherein the front is open.

34. The refrigerated display case of claim 20, wherein the front is open.

35. The refrigerated display case of claim 20, further comprising at least one fan-coil unit in airflow communication with the duct and the receiver.

* * * * *